US011075476B2

(12) United States Patent
Hsiao et al.

(10) Patent No.: US 11,075,476 B2
(45) Date of Patent: Jul. 27, 2021

(54) HIGH SPEED WIRE END CONNECTOR

(71) Applicant: BizLink International Corp., New Taipei (TW)

(72) Inventors: Hsin-Tuan Hsiao, New Taipei (TW); Jui-Hung Chien, New Taipei (TW)

(73) Assignee: BizLink International Corp., New Taipei (TW)

( * ) Notice: Subject to any disclaimer, the term of this patent is extended or adjusted under 35 U.S.C. 154(b) by 0 days.

(21) Appl. No.: 16/872,344

(22) Filed: May 11, 2020

(65) Prior Publication Data

US 2020/0366019 A1 Nov. 19, 2020

(30) Foreign Application Priority Data

May 15, 2019 (TW) ..... 108206081

(51) Int. Cl.

| | |
|---|---|
| ***H01R 12/77*** | (2011.01) |
| ***H01R 13/627*** | (2006.01) |
| ***H01R 13/504*** | (2006.01) |
| ***H01R 12/62*** | (2011.01) |

(52) U.S. Cl.

CPC ..... *H01R 12/774* (2013.01); *H01R 12/62* (2013.01); *H01R 13/504* (2013.01); *H01R 13/6275* (2013.01)

(58) Field of Classification Search

CPC .... H01R 12/62; H01R 12/771; H01R 12/772; H01R 12/774; H01R 13/504; H01R 13/6275

See application file for complete search history.

(56) References Cited

U.S. PATENT DOCUMENTS

| | | | | |
|---|---|---|---|---|
| 5,609,499 | A * | 3/1997 | Tan | H01R 4/70 439/353 |
| 7,232,329 | B1 * | 6/2007 | Wu | H01R 12/62 439/358 |
| 7,261,582 | B2 * | 8/2007 | Wu | H01R 13/506 439/352 |
| 8,439,706 | B2 * | 5/2013 | Sytsma | H01R 13/65802 439/607.46 |
| 10,135,198 | B2 * | 11/2018 | Lin | H01R 13/506 |
| 2010/0273335 | A1 * | 10/2010 | Wu | H01R 12/79 439/80 |

* cited by examiner

*Primary Examiner* — Oscar C Jimenez

(74) *Attorney, Agent, or Firm* — CKC & Partners Co., LLC

(57) ABSTRACT

A high speed wire end connector includes a printed circuit board, a cable, an inner film, an outer casing, and a molded bonding layer. The cable is soldered to the printed circuit board, the inner film covers a part of the cable and a part of the printed circuit board, and the outer casing is used to fix the printed circuit board, the cable and the printed circuit board, and a part of the printed circuit board is passed through a guide hole of the outer casing. The molded bonding layer bonds the outer casing to the inner film. In addition, a metal spring latch is mounted on the outer casing.

12 Claims, 6 Drawing Sheets

HIGH SPEED WIRE END CONNECTOR

RELATED APPLICATIONS

This application claims priority to Taiwan Application Serial Number 108206081, filed May 15, 2019, which is herein incorporated by reference.

TECHNICAL FIELD

The present disclosure generally relates to a wire end connector. More particularly, the present disclosure relates to a high speed wire end connector.

BACKGROUND

With the development and innovation of various high frequency electronic products, new high frequency electronic products require relatively more bandwidth. Therefore, the world today relies on the rapid and reliable information transmission.

In the electronic communication equipment for transferring large volumes of information, the wire-to-board connector is one kind of connector device widely used in electronic communication field, which includes a wire-end connector and a board end connector. Normally, the board-end connector is mounted on a circuit board.

At present, in high-speed transmission devices, Slim Serial Attached Small Computer System Interface (Slim SAS) and Slim SAS Low Profile are widely used in the computer equipment of data centers, especially in the computer equipment such as servers, switches, storage and workstations.

However, the conventional Slim SAS transmission line usually has too much attenuation on the signal due to a long circuit board of the connector so as to difficultly increase the transmission rate thereof. In addition, the components of the assembled connector of the Slim SAS Low Profile transmission line usually include tolerances therebetween. Therefore, the fit differences of the components may cause positioning problems for connecting the connectors.

SUMMARY

One objective of the embodiments of the present invention is to provide a high speed wire end connector, thereby improving the transmission rate and transmission quality of the high speed wire end connector.

To achieve these and other advantages and in accordance with the objective of the embodiments of the present invention, as the embodiment broadly describes herein, the embodiments of the present invention provides a high speed wire end connector including a printed circuit board, a cable, an inner film, an outer casing and a molded bonding layer. The cable is soldered to the printed circuit board, and the inner film covers a part of the cable and a part of the printed circuit board. The outer casing fixes the printed circuit board, the cable and the printed circuit board, and a part of the printed circuit board passes through a guide hole of the outer casing. The molded bonding layer bonds the outer casing to the inner film. In addition, a metal spring latch is mounted on the outer casing.

In some embodiments, the outer casing includes a fixing tongue, and the metal spring latch is fixed on the fixing tongue.

In some embodiments, the outer casing further includes a U-shaped protection protrusion, and the U-shaped protection protrusion and the fixing tongue surround the printed circuit board.

In some embodiments, the outer casing further includes a plurality of limiting protrusions to restrict the inner film in the outer casing. In addition, the molded bonding layer includes a plurality of adhesive grooves to bond corresponding limiting protrusions.

In some embodiments, the outer casing further includes a plurality of adhesive recesses formed between the limiting protrusions to bond to adhesive bumps of the molded bonding layer.

In some embodiments, the limiting protrusions further include at least one first limiting protrusion and at least one second limiting protrusion corresponding to a first surface of the inner film, and the first surface is parallel to a surface of the printed circuit board.

In some embodiments, the limiting protrusions further include at least one third limiting protrusion corresponding to a second surface of the inner film, and the second surface is perpendicular to the surface of the printed circuit board.

In some embodiments, the limiting protrusions further include at least one fourth limiting protrusion corresponding to a third surface of the inner film, and the third surface is perpendicular to the surface of the printed circuit board and the second surface.

In some embodiments, the outer casing further includes a plurality of adhesive lugs, and the molded bonding layer further includes a plurality of adhesive grooves to bond to the adhesive lugs.

In some embodiments, the adhesive lugs further include a plurality of openings, and the molded bonding layer further includes a plurality of adhesive bumps to respectively bond to the openings.

In some embodiments, the molded bonding layer further includes at least one positioning hole to expose the inner film.

In some embodiments, the outer casing further includes a sliding slot to guide the printed circuit board sliding into the guide hole of the outer casing.

Hence, the high speed wire end connector can reduce the length of the printed circuit board with the injection molding outer casing and the printed circuit board. The inner film, the molded bonding layer and the limiting protrusions of the outer casing can effectively improve the position accuracy and water resistance capacity of the high speed wire end connector so as to further improve the whole production quality and transmission rate and transmission quality of the high speed wire end connector.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
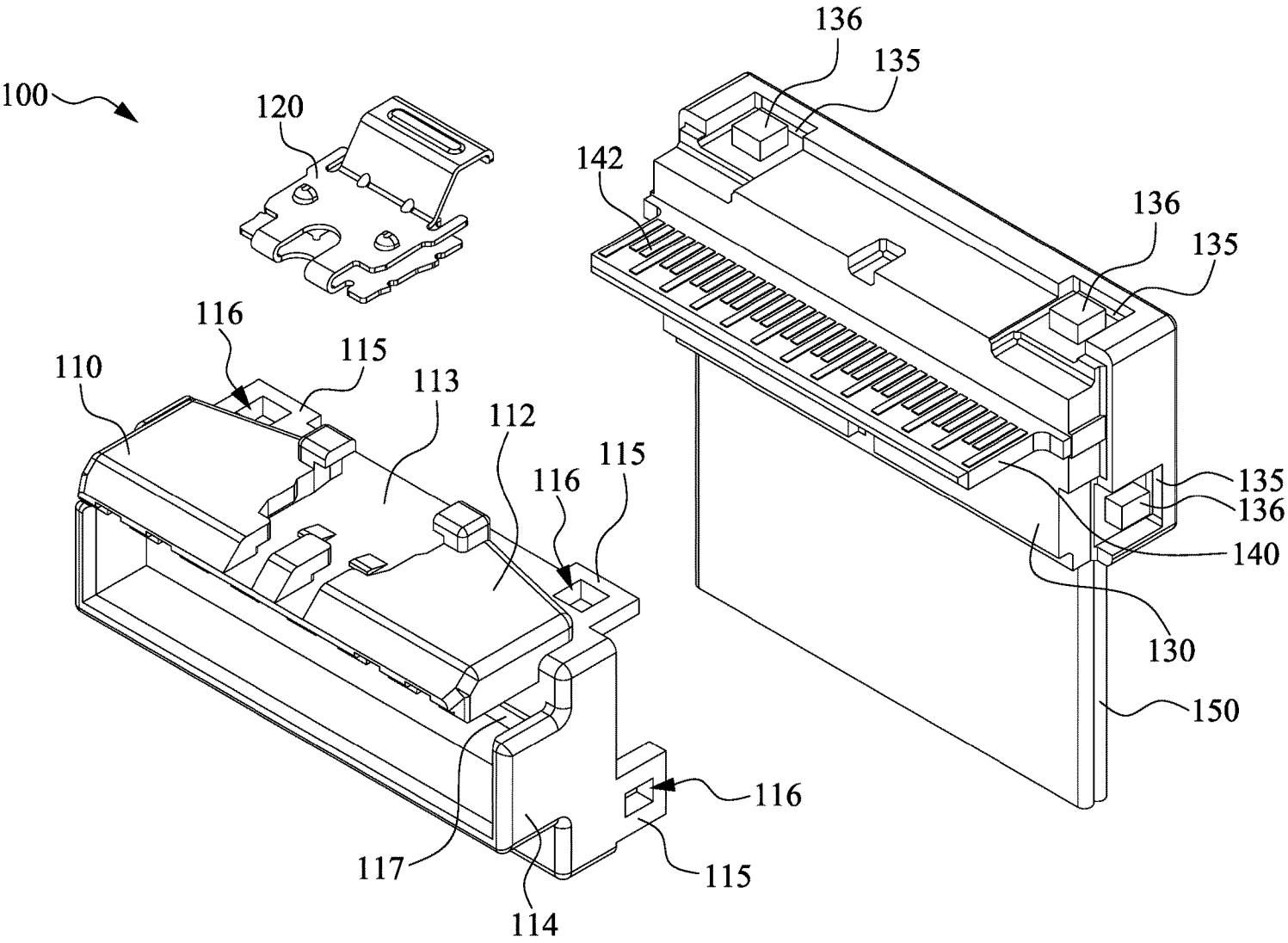
FIG. 1 illustrates a schematic perspective view showing a high speed wire end connector according to one embodiment of the present invention.
Figure 2:
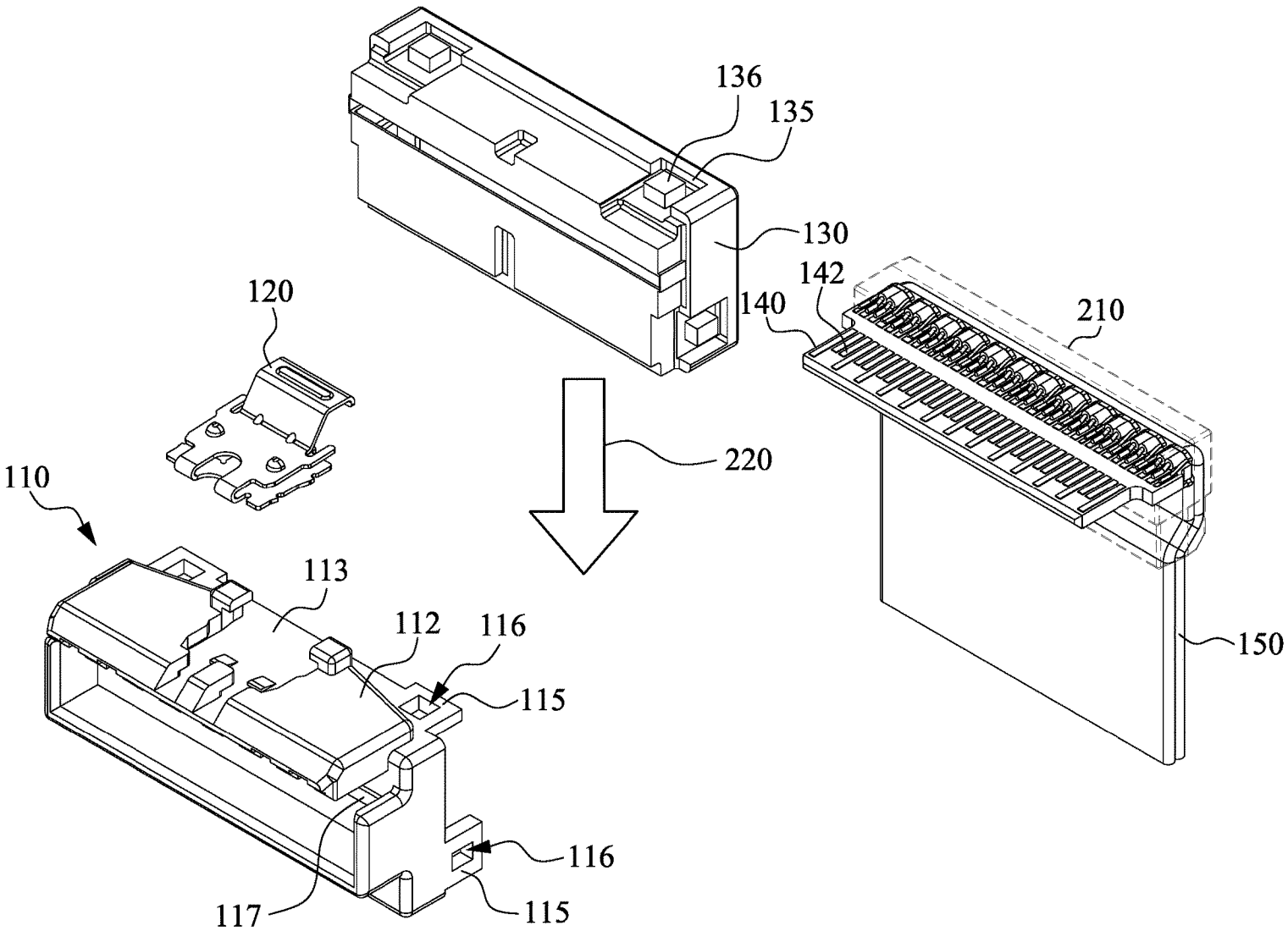
FIG. 2 illustrates an exploded view of the high speed wire end connector of FIG. 1.
Figure 3:
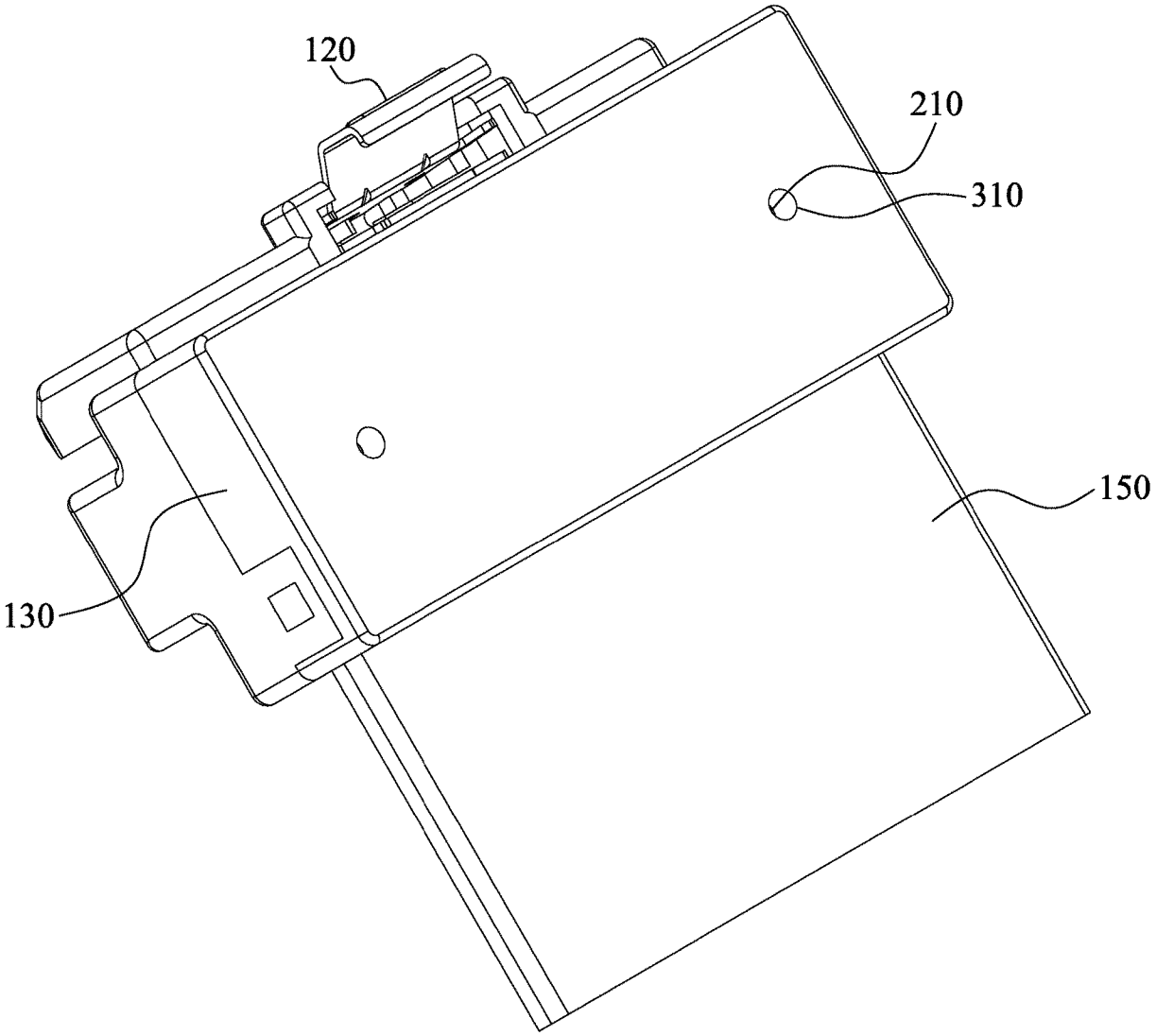
FIG. 3 illustrates a rear view of the high speed wire end connector of FIG. 1.
Figure 4:
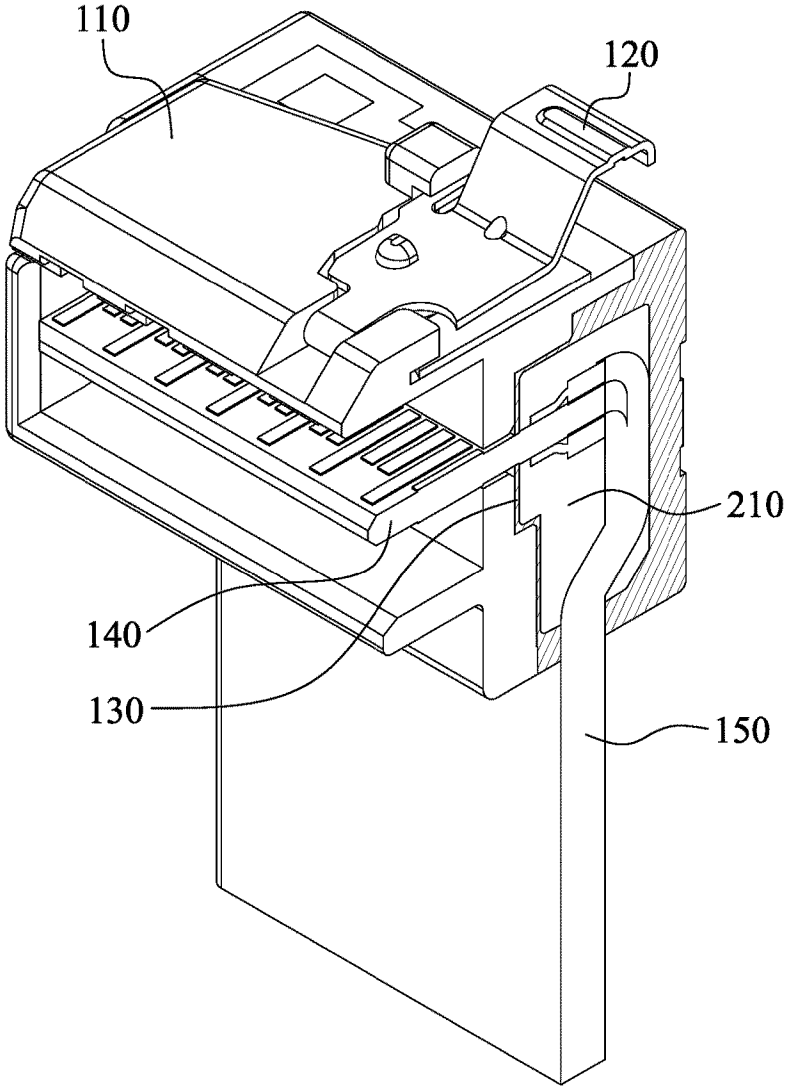
FIG. 4 illustrates a partial cross-sectional view of the high speed wire end connector of FIG. 1.
Figure 5:
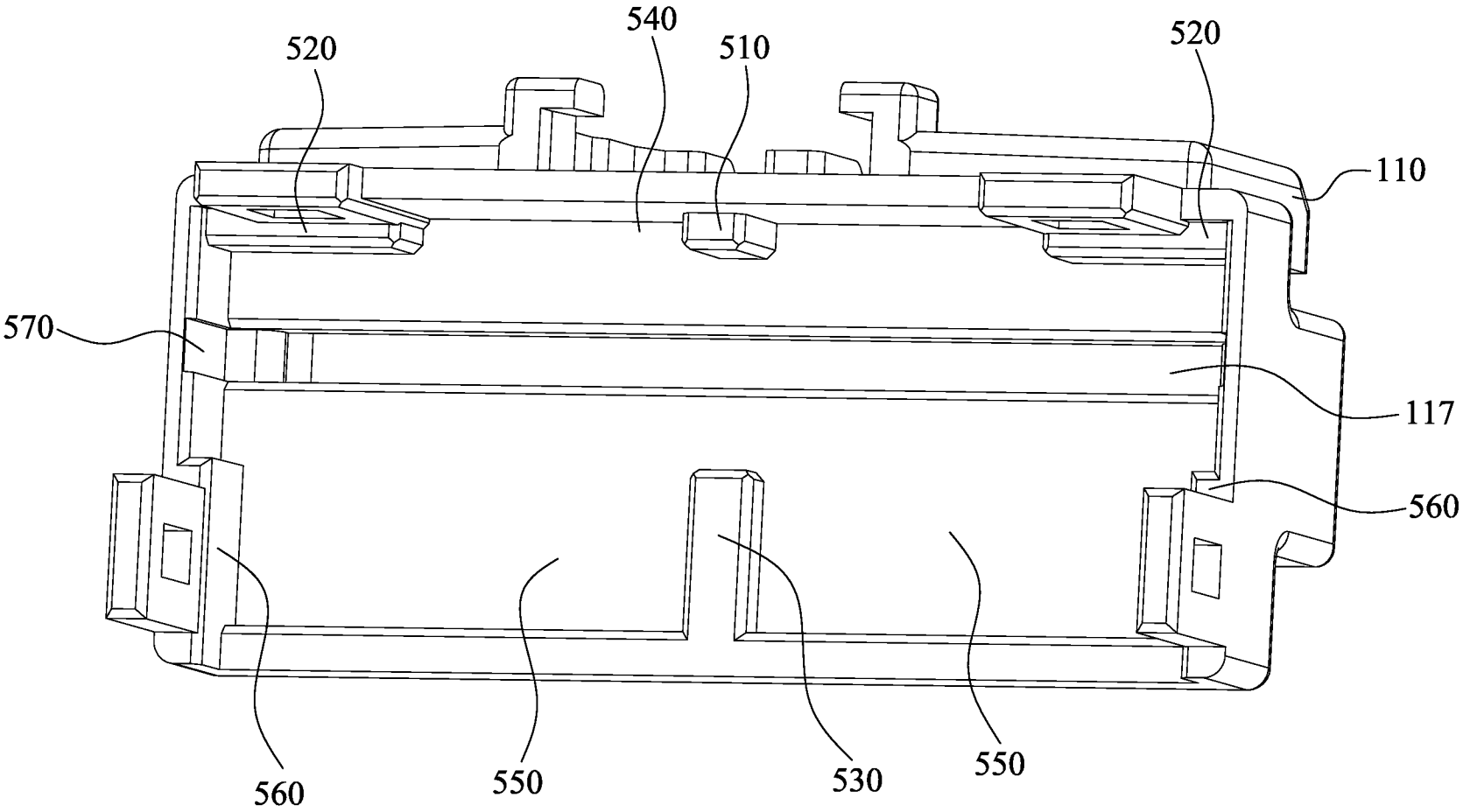
FIG. 5 illustrates a schematic perspective view showing an outer casing of the high speed wire end connector of FIG. 1.
Figure 6:
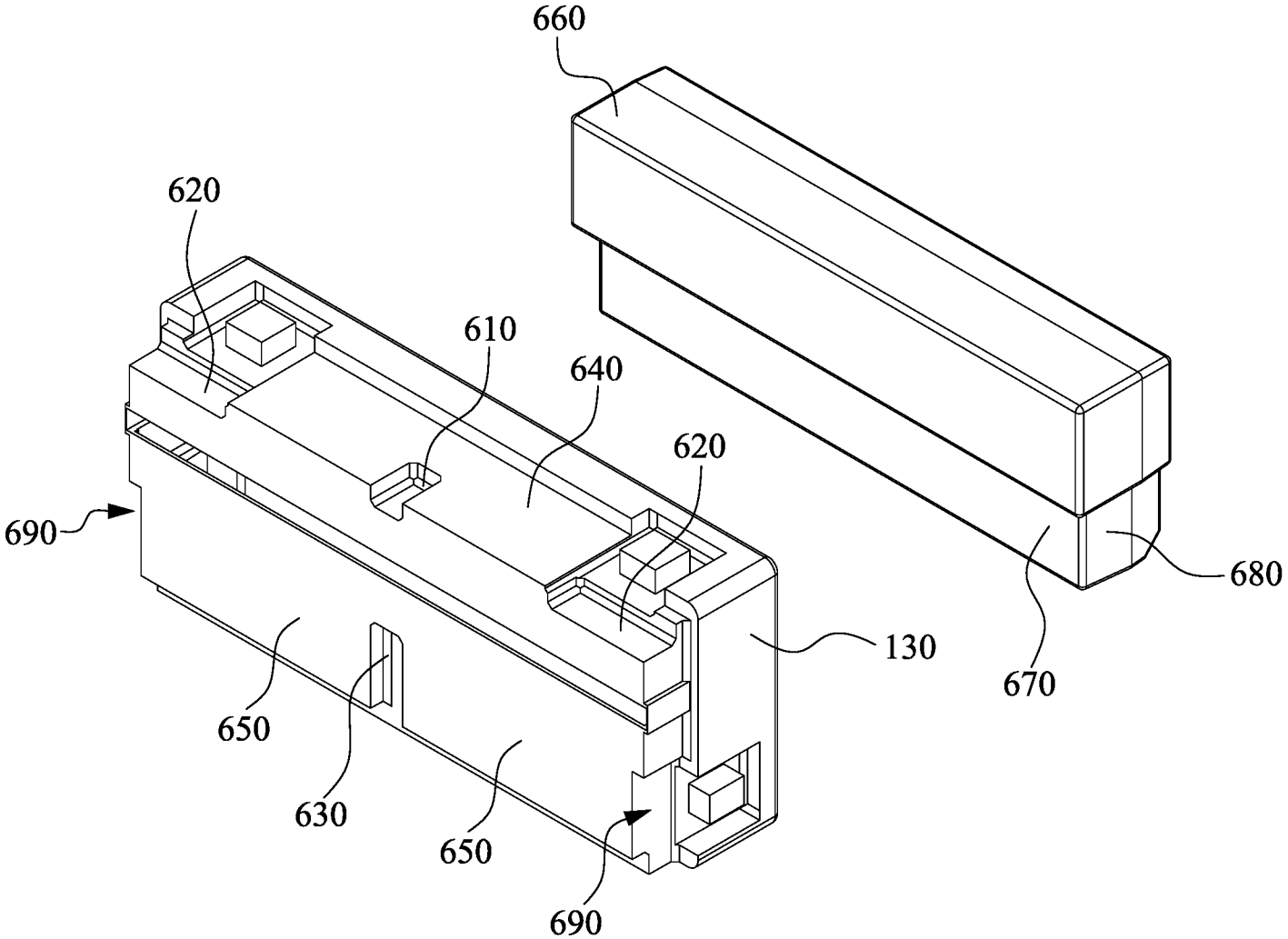
FIG. 6 illustrates a schematic perspective view showing a molded bonding layer and an inner film of the high speed wire end connector of FIG. 1.

Refer to FIGS. 1-6. FIG. 1 illustrates a schematic perspective view showing a high speed wire end connector according to one embodiment of the present invention, FIG. 2 illustrates an exploded view of the high speed wire end connector thereof, FIG. 3 illustrates a rear view thereof, FIG. 4 illustrates a partial cross-sectional view thereof, FIG. 5 illustrates a schematic perspective view showing an outer casing thereof, and FIG. 6 illustrates a schematic perspective view showing a molded bonding layer and an inner film thereof.

The high speed wire end connector 100 includes a printed circuit board 140, a cable 150, an inner film 210, an outer casing 110 and a molded bonding layer 130. The cable 150 is soldered on the printed circuit board 140 to electrically connect the metal terminals 142 on the printed circuit board 140.

In some embodiments, the cable 150 includes a 90 degrees elbow and the cable 150 is soldered on the printed circuit board 140.

In addition, the inner film 210 is formed by inner molding process to cover a part of the cable 150 and a part of the printed circuit board 140 to protect solder joints of the cable 150 and the printed circuit board 140 to improve the service lifetime of the high speed wire end connector 100.

The outer casing 110 is utilized to protect the inner film 210, the cable 150 and the printed circuit board 140 in the outer casing 110, and utilized to couple to a corresponding board end connector. A part of the printed circuit board 140 may pass through a guide hole 117 of the outer casing 110 to allow the metal terminals 142 of the printed circuit board 140 electrically connecting to the corresponding board end connector. In addition, the molded bonding layer 130 is formed by the outer molding process 220 to effectively bond the outer casing 110 to the inner film 210, and the molded bonding layer 130 can accurately and stably fix the outer casing 110, the inner film 210, the cable 150 and the printed circuit board 140 so as to improve the water resistance capability of the high speed wire end connector 100 and the product quality of the high speed wire end connector 100.

In some embodiments, the high speed wire end connector 100 further includes a metal spring latch 120 disposed at the position of the latch holder 113 of the outer casing 110 to engage with the positioning opening of the corresponding board end connector.

In some embodiments, the outer casing 110 includes a fixing tongue 112, and the metal spring latch 120 is fixed in the latch holder 113 of the fixing tongue 112.

In some embodiments, the outer casing 110 further includes a U-shaped protection protrusion 114, and the U-shaped protection protrusion 114 and the fixing tongue 112 surround the printed circuit board 140 to protect the printed circuit board 140 and provide a stable and safe connection while connecting to the corresponding board end connector.

In some embodiments, the outer casing 110 further includes a plurality of limiting protrusions, for example a first limiting protrusion 510 and a second limiting protrusion 520, corresponding to a first surface 660 of the inner film 210, and the first surface 660 of the inner film 210 is approximately parallel to a surface of the printed circuit board 140. Hence, the first limiting protrusion 510 and the second limiting protrusion 520 can limit a relative height of the inner film 210 and the outer casing 110.

In some embodiments, the outer casing 110 further includes a plurality of limiting protrusions, for example, third limiting protrusions 530, corresponding to a second surface 670 of the inner film 210, and the second surface 670 is approximately perpendicular to the surface of the printed circuit board 140 to ensure a protruding length of the printed circuit board 140 protruding from the guide hole 117.

In some embodiments, the outer casing 110 further includes a plurality of limiting protrusions, for example, fourth limiting protrusions 560, disposed on both sides of an interior opening of the outer casing 110 to ensure the relative left and right positions of the printed circuit board 140 and the outer casing 110. The fourth limiting protrusions 560 are corresponding to a third surface 680 of the inner film 210, and the third surface 680 is approximately perpendicular to the surface of the printed circuit board 140 and the second surface 670.

In some embodiments, the molded bonding layer 130 includes a plurality of adhesive grooves, for example, a first adhesive groove 610 corresponding to the first limiting protrusion 510, a second adhesive groove 620 corresponding to the second limiting protrusion 520, a third adhesive groove 630 corresponding to the third limiting protrusion 530 and a fourth adhesive groove 690 corresponding to the fourth limiting protrusion 560.

The inner film 210 is restricted between the first limiting protrusion 510, the second limiting protrusion 520, the third limiting protrusion 530 and the fourth limiting protrusion 560 of the outer casing 110 to ensure the relative position of the inner film 210 and the outer casing 110. When the relative position of the inner film 210 and the outer casing 110 is fixed, the components of the high speed wire end connector 100 are disposed in the accurately positions thereof.

In some embodiments, the first limiting protrusion 510 and the second limiting protrusion 520 are disposed on a surface under the fixing tongue 112 and parallel to the surface of the printed circuit board 140 so as to restrict the height of the inner film 210. The third limiting protrusion 530 is disposed under the guide hole 117 to ensure the protruding length of the printed circuit board 140 protruding from the guide hole 117. The fourth limiting protrusions 560 are disposed on both left and right sides inside the outer casing 110 to ensure the relative left and right positions of the printed circuit board 140 and the outer casing 110. In addition, adhesive recesses 540 and adhesive recesses 550 are formed between the inner film 210 and the outer casing 110 while the limiting protrusions are formed in the outer casing 110.

After the inner film 210, the printed circuit board 140 and the cable 150 are positioned in the interior opening of the outer casing 110, an outer molding process 220 is conducted to form a molded bonding layer 130 therein. The molded bonding layer 130 bonds the outer casing 110, the inner film 210, the printed circuit board 140 and the cable 150 to accurately fix the relative components of the high speed wire end connector 100.

In some embodiments, the molded bonding layer 130 includes a plurality of adhesive bumps, for example, adhesive bumps 640 and adhesive bumps 650 to effectively bond to the adhesive recesses 540 and the adhesive recesses 550 of the outer casing 110. With the adhesive recesses 540 and the adhesive recesses 550, the material for forming the molded bonding layer 130 can appropriately flow in the space while performing the outer molding process 220 to effectively increase the adhesive strength of the molded bonding layer 130 to bond the outer casing 110 to the inner film 210, and also effectively increase the water resistance capability of the high speed wire end connector 100.

In some embodiments, the outer casing 110 further includes a plurality of adhesive lugs 115, and the molded bonding layer 130 further includes a plurality of adhesive grooves 135 to bond the corresponding adhesive lugs 115.

In some embodiments, the adhesive lugs 115 further include openings 116, and the molded bonding layer 130 further includes a plurality of adhesive bumps 136 to respectively bond the corresponding openings 116.

In some embodiments, the molded bonding layer 130 further includes at least one positioning hole 310 to expose the inner film 210, and a positioning pin can fix the inner film 210 between the limiting protrusions of the outer casing 110 through the positioning hole 310 while performing the outer molding process 220.

In some embodiments, the outer casing 110 further includes a sliding slot 570 to enable the printed circuit board 140 sliding into the guide hole 117 of the outer casing 110.

Accordingly, the high speed wire end connector can reduce the length of the printed circuit board with the injection molding outer casing and the printed circuit board. The inner film, the molded bonding layer and the limiting protrusions of the outer casing can effectively improve the position accuracy and water resistance capacity of the high speed wire end connector so as to further improve the whole production quality and transmission rate and transmission quality of the high speed wire end connector.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A high speed wire end connector, comprising:

a printed circuit board;

a cable soldered to the printed circuit board;

an inner piece covering a part of the cable and a part of the printed circuit board;

an outer casing fixed with the printed circuit board, the cable and the printed circuit board, and a part of the printed circuit board passing through a guide hole of the outer casing; and a molded bonding layer bonding the outer casing to the inner piece, wherein the outer casing further comprises a plurality of adhesive lugs, the molded bonding layer further comprises a plurality of adhesive grooves to bond to the adhesive lugs, the adhesive lugs further comprise a plurality of openings, and the molded bonding layer further comprises a plurality of adhesive bumps to respectively bond to the openings.

2. The high speed wire end connector of claim 1, further comprising a metal spring latch mounted on the outer casing.

3. The high speed wire end connector of claim 2, wherein the outer casing comprises a fixing tongue, and the metal spring latch fixed on the fixing tongue.

4. The high speed wire end connector of claim 3, wherein the outer casing further comprises a U-shaped protection protrusion, and the U-shaped protection protrusion and the fixing tongue surround the printed circuit board.

5. The high speed wire end connector of claim 1, wherein the outer casing further comprises a plurality of limiting protrusions to restrict the inner piece in the outer casing.

6. The high speed wire end connector of claim 5, wherein the adhesive grooves bond corresponding limiting protrusions.

7. The high speed wire end connector of claim 6, wherein the outer casing further comprises a plurality of adhesive recesses formed between the limiting protrusions to bond to the adhesive bumps of the molded bonding layer.

8. The high speed wire end connector of claim 7, wherein the limiting protrusions further comprise at least one first limiting protrusion and at least one second limiting protrusion corresponding to a first surface of the inner piece, and the first surface is parallel to a surface of the printed circuit board.

9. The high speed wire end connector of claim 8, wherein the limiting protrusions further comprise at least one third limiting protrusion corresponding to a second surface of the inner piece, and the second surface is perpendicular to the surface of the printed circuit board.

10. The high speed wire end connector of claim 9, wherein the limiting protrusions further comprise at least one fourth limiting protrusion corresponding to a third surface of the inner piece, and the third surface is perpendicular to the surface of the printed circuit board and the second surface.

11. The high speed wire end connector of claim 1, wherein the molded bonding layer further comprises at least one positioning hole to expose the inner piece.

12. The high speed wire end connector of claim 1, wherein the outer casing further comprises a sliding slot to guide the printed circuit board sliding into the guide hole of the outer casing.

* * * * *